United States Patent [19]

Mochizuki et al.

[11] 4,099,371

[45] Jul. 11, 1978

[54] ELECTRONIC OPTICAL DISPLAY ALARM TIMEPIECE

[75] Inventors: Yoshifumi Mochizuki, Tokorozawa; Shigeru Morokawa, Tokyo, both of Japan

[73] Assignee: Citizen Watch Co., Ltd., Tokyo, Japan

[21] Appl. No.: 618,756

[22] Filed: Oct. 2, 1975

[30] Foreign Application Priority Data

Oct. 4, 1974 [JP] Japan ..... 49-114498
Dec. 18, 1974 [JP] Japan ..... 49-145183

[51] Int. Cl.[2] ..... G04B 23/02; G04C 21/00
[52] U.S. Cl. ..... 58/22.7; 58/38 R
[58] Field of Search ..... 58/22.7, 38 R, 57.5, 58/50 R, 152 B

[56] References Cited

U.S. PATENT DOCUMENTS

| | | | |
|---|---|---|---|
| 3,328,953 | 7/1967 | Balchanas et al. | 58/22.7 |
| 3,745,761 | 7/1973 | Tsuruishi | 58/38 |
| 3,813,533 | 5/1974 | Cone et al. | 58/50 R |
| 3,822,547 | 7/1974 | Fujita | 58/38 R |
| 3,834,153 | 9/1974 | Yoda et al. | 58/38 R |
| 3,871,168 | 3/1975 | Maire et al. | 58/85.5 |
| 3,940,919 | 3/1976 | Yasuda et al. | 58/38 R |

*Primary Examiner*—Edith S. Jackmon
*Attorney, Agent, or Firm*—Koda and Androlia

[57] ABSTRACT

An electronic timepiece including an optical display for both the time and the alarm time setting, an audible alarm, an alarm circuit, an optical display to indicate the state of operation of the alarm circuit, and a means for determining in advance whether the alarm circuit will be operated only once or every time the alarm time setting coincides with the time. Furthermore, the single optical time display is shared to indicate the time and to indicate the alarm time setting while the alarm time is being set. Also, the optical display to indicate the state of operation of the alarm circuit indicates if an alarm setting has been made and whether the alarm setting will occur only once or repetitively.

1 Claim, 16 Drawing Figures

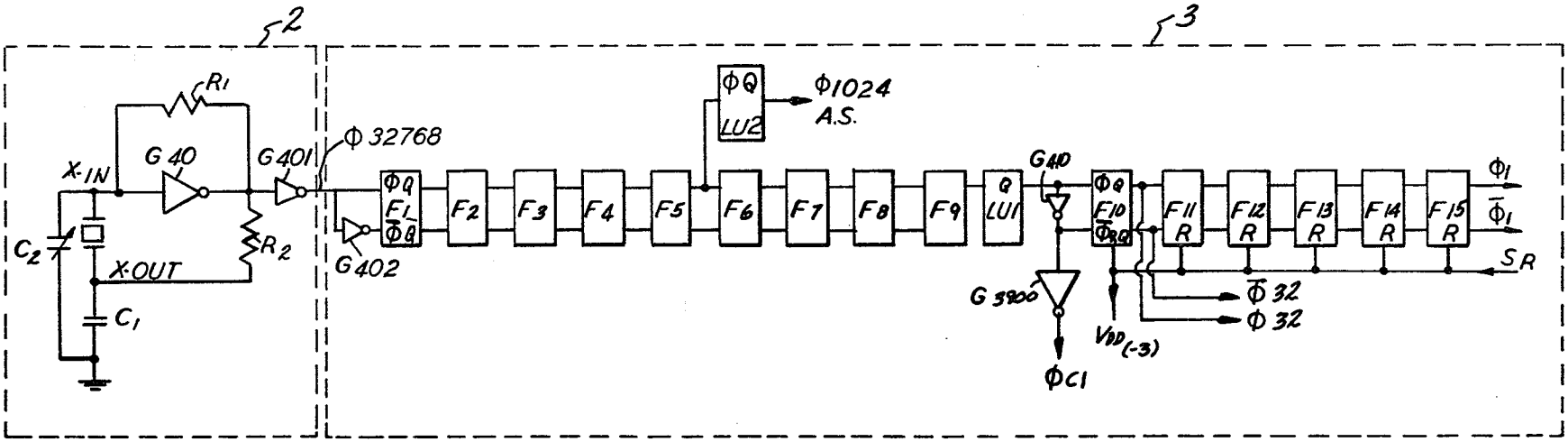
FIG-8
FIG-9
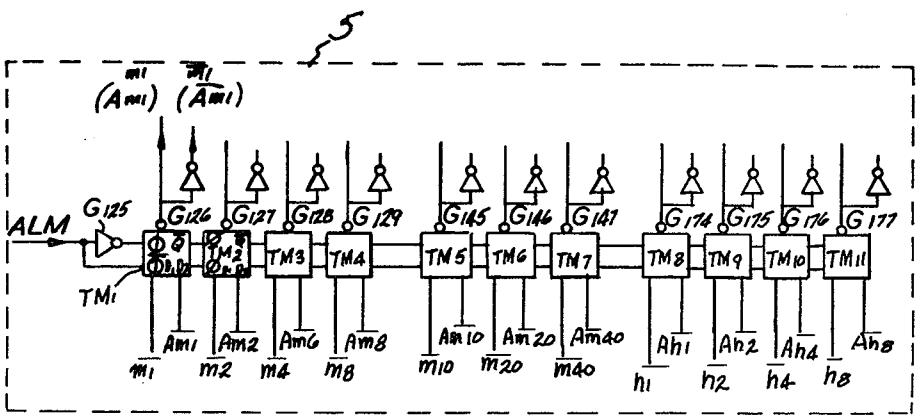
FIG-11
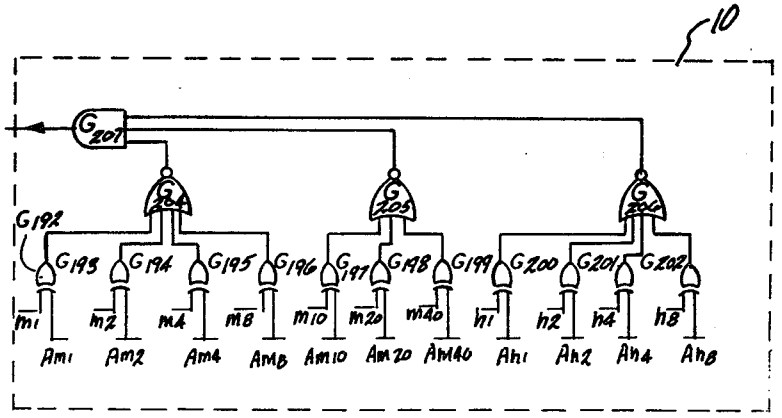
FIG-10

11
4
9
AH
AM
SR
G
H
M

| 8 | 4 | 2 | 1 | | A | B | C | D | E | F | G | K |
|---|---|---|---|---|---|---|---|---|---|---|---|---|
| 0 | 0 | 0 | 0 | 0 | ● | ● | ● | ● | ● | ● | | |
| 0 | 0 | 0 | 1 | 1 | | ● | ● | | | | | |
| 0 | 0 | 1 | 0 | 2 | ● | ● | | ● | ● | | ● | |
| 0 | 0 | 1 | 1 | 3 | ● | ● | ● | ● | | | ● | |
| 0 | 1 | 0 | 0 | 4 | | ● | ● | | | ● | ● | |
| 0 | 1 | 0 | 1 | 5 | ● | | ● | ● | | ● | ● | |
| 0 | 1 | 1 | 0 | 6 | ● | | ● | ● | ● | ● | ● | |
| 0 | 1 | 1 | 1 | 7 | ● | ● | ● | | | | | |
| 1 | 0 | 0 | 0 | 8 | ● | ● | ● | ● | ● | ● | ● | |
| 1 | 0 | 0 | 1 | 9 | ● | ● | ● | ● | | ● | ● | |
| 1 | 0 | 1 | 0 | 10 | ● | ● | ● | ● | ● | ● | | ● |
| 1 | 0 | 1 | 0 | 11 | | ● | ● | | | | | ● |

FIG-16

ELECTRONIC OPTICAL DISPLAY ALARM TIMEPIECE

FIELD OF THE INVENTION

The present invention relates to an alarm for a timepiece, and particularly to an alarm for an electronic timepiece that utilizes an optical display.

DESCRIPTION OF THE PRIOR ART

A timepiece which has an alarm must include at least the following two functions in its display elements:

a means to indicate ordinary time, and a means to indicate the alarm time setting.

In mechanical clocks, an indicator is constructed involving hour, minute-second pointers and a marking pointer that indicates the time set for the alarm. Accordingly, a compact arrangement is made on the dial so that it is possible to read both the time and the alarm setting time simultaneously at a single glance.

On the other hand, an electronic timepiece that uses optical display elements will require a multitude of indicating segments to indicate a time point. For example, a set of 34 segments are needed to indicate the hour, minute and second by means of FIG. 8, seven segment optical display elements. An indication for an alarm time set point will require 23 additional segments of the seven segment display elements even though the display is limited to only hours and minutes. Increasing the number of display elements leads to an increase in the complexity of segment connections, integrated circuit logic, and constraints on the design as well as increased demands on manufacturing technology thereby causing an increase in costs. The method that exists in the prior art which suggests as a remedy to the above-described difficulties a single set of display elements is used to display the two times by switching from one to the other. However, since the same type of letters will appear on identical indicating elements, it is difficult to glance at the display and read both the time and the alarm time setting.

SUMMARY OF THE INVENTION

In keeping with the principles of the present invention, the objects are accomplished by an electronic timepiece including an optical display for displaying time, an audible alarm, an alarm circuit, an optical display to indicate the state of operation of the alarm circuit, and means for determining in advance whether the alarm circuit will be operated only once or every time the alarm time setting coincides with the time. Furthermore, the single optical time display is shared to indicate the time and to indicate the alarm time setting while the alarm time is being set. While displaying the time, the single optical time display displays the hours, minutes and seconds. While displaying the alarm time setting, only hours and minutes need be displayed. Furthermore, the opital display to indicate the state of operation of the alarm circuit indicates not only if an alarm setting has been made, but also whether the alarm setting will occur only once or repetitively. The alarm circuit includes a means whereby the wearer may set in advance whether the alarm will be operated only once or every time the alarm time setting coincides with the time.

Accordingly, it is a general object of the present invention to provide an electronic timepiece having an alarm and a single optical display whereon the time and the alarm time setting are displayed selectively.

It is another object of the present invention to provide an electronic timepiece having a alarm which has a optical display for indicating the state of operation of the alarm circuit.

It is still another object of the present invention to provide an electronic timepiece having an alarm which has a optical display which is on when the alarm time is set and off when the alarm time is not set.

It is yet another object of the present invention to provide an electronic timepiece having a alarm which the wearer may determine in advance whether the alarm circuit will be operated only once or every time the alarm time setting coincides with the time.

It is a further object of the present invention to provide an electronic timepiece having an alarm which has an optical display for indicating whether the alarm will occur only once or every time the alarm time setting coincides with the time.

BRIEF DESCRIPTION OF THE DRAWINGS

The above-mentioned and other features and objects of the present invention will become more apparent by reference to the following description taken in conjunction with the accompanying drawings, wherein like reference numerals denote like elements, and in which:

FIG. 8 is a logic circuit diagram of a quartz crystal oscillator utilized in the electronic timepiece of FIG. 1;

FIG. 9 is a logic circuit diagram of a frequency reduction circuit utilized in the electronic timepiece of FIG. 1;

FIG. 10 is a logic circuit diagram of a coincidence detector circuit utilized in the electronic timepiece of FIG. 1;

FIG. 11 is a logic circuit diagram of the display switch utilized in the electronic timepiece of FIG. 1;

FIG. 16 is the truth table for the decoder of FIG. 15.

DESCRIPTION OF THE PREFERRED EMBODIMENTS

Figure 1:
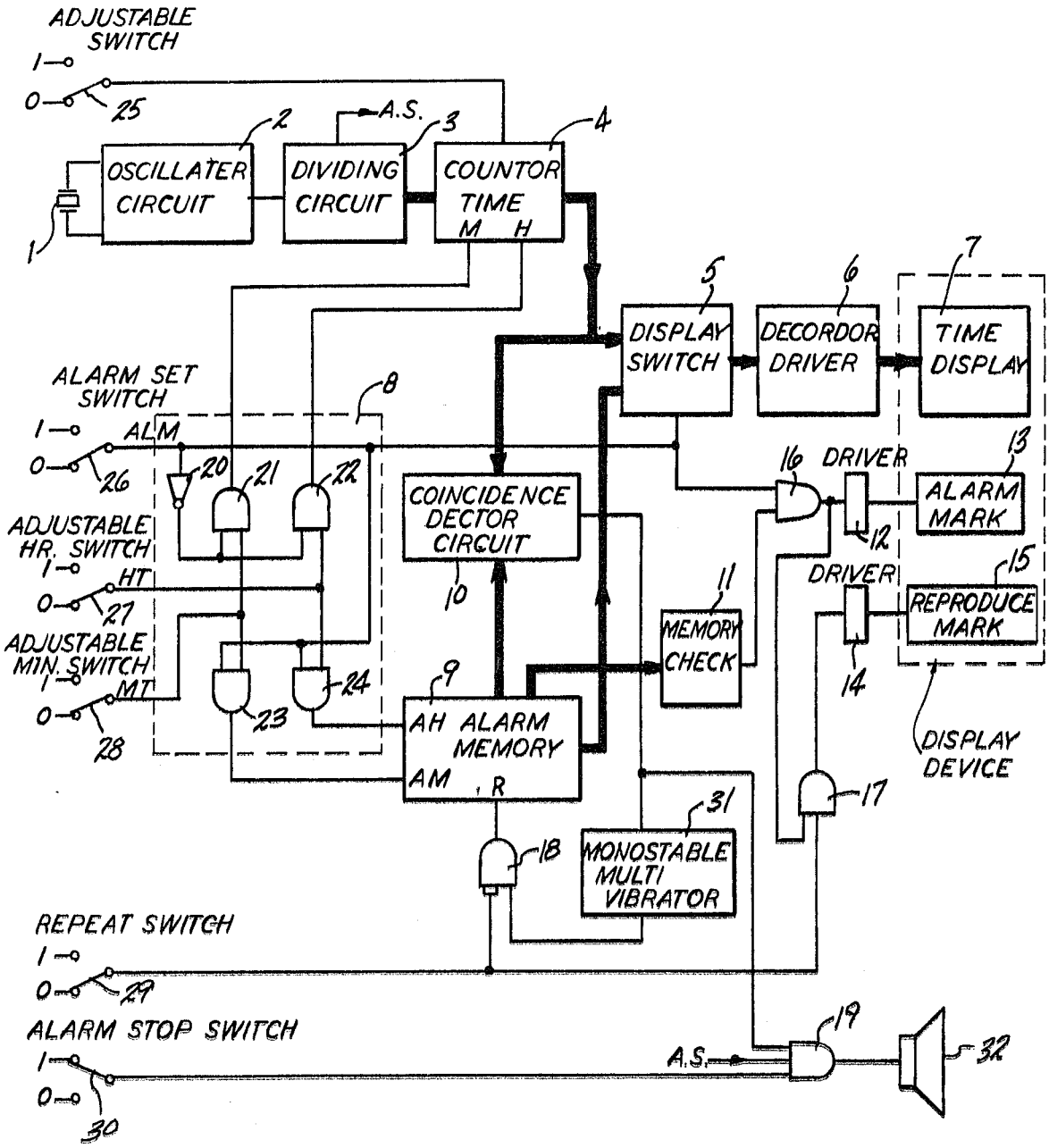
FIG. 1 is a block diagram of an electronic timepiece having an alarm in accordance with the teachings of the present invention.

FIG. 1 is a block diagram of a logic circuit illustrating an electronic timepiece in accordance with the teachings of the present invention in which the reference oscillator circuit includes a quartz crystal and electronic optical display elements such as liquid crystal, light emitting diodes, etc., are used for the optical display. The optical display is driven by an electronic circuit and a preset alarm point is also memorized by means of an electronic circuit.

Referring to FIG. 1, the electronic timepiece includes a quartz crystal 1. Quartz crystal 1 is coupled to a crystal oscillator circuit 2. The output of the crystal oscillator circuit is coupled to frequency dividing circuit 3 by which the signal from oscillator circuit 2 is reduced in frequency to 1 Hz. Dividing circuit 3 is coupled to clock pulse counter circuit 4 which receives the 1 Hz signal from frequency dividing circuit 3 and counts time information such as seconds, minutes, hours, etc. The output of counter circuit 4 is coupled to display switching device 5 which switches the display from alarm time to ordinary time and vice-versa. The output of switching device 5 is coupled to decoder driver 6. Decoder driver 6 drives time display 7. Furthermore, frequency divider circuit 3 also puts out a 1024 Hz signal as the alarm signal AS.

The inputs of switching circuit 8 are coupled to alarm set switch 26, adjustable hour switch 27, and adjustable minute switch 28. The outputs of switching circuit 8 are coupled to the M and H inputs of clock pulse counter circuit 4 and the AH and AM inputs of the alarm memory 9. One output of alarm memory 9 is coupled to coincidence detector circuit 10 which detects the coincidence of an alarm time setting and the real time. Another output of alarm memory 9 is coupled to memory check circuit 11 which senses that an alarm time setting is set or not set. The output of check circuit 11 together with an output of display switch 5 are coupled to the input of logic gate 16. The output of logic gate 16 is coupled to the input of alarm mark display driver circuit 12 and an input of logic gate 17. The other input of logic gate 17 is coupled to repeat switch 29 and the output of logic gate 17 is coupled to reproduce mark display driver 14. The output of driver 12 is coupled to alarm mark display 13. Furthermore, the output of driver 14 is coupled to reproduce mark display. Logic gates 20, 21, 22, 23 and 24 are interconnected and form switching circuit 8.

Timepiece adjustable switch 25 is coupled to an input of clock pulse counter 4. In addition, alarm stop switch 30 is coupled to an input of logic gate 19 together with the alarm signal from frequency dividing circuit 3 and the output of coincidence detector circuit 10. The output of logic gate 19 is coupled to audible alarm 32.

Figure 2:
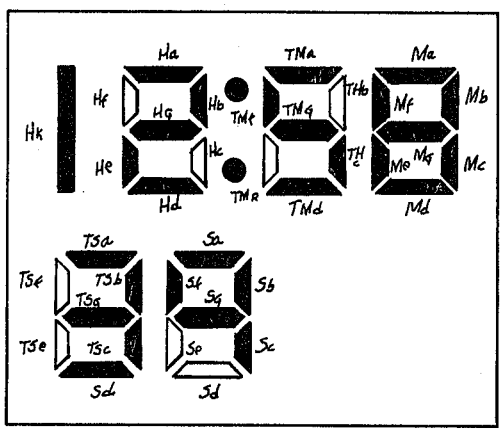
FIG. 2 is a drawing of the optical display displaying the time only.

The coupling conditions and functions of each of the elements forming the functional blocks will be explained in the following. A signal of 32,768 Hz is generated by a quartz crystal 1 and oscillator circuit 2 which is reduced to one Hz in frequency divider circuit 3. The One Hz signal is coupled to the input of clock pulse counter 4 in which signals $\overline{m}_1$, $\overline{m}_2$, $\overline{m}_4$, $\overline{m}_8$ for one, two, four, and eight minutes as units, respectively, and signals $\overline{m}_{10}$, $\overline{m}_{20}$, $\overline{m}_{40}$, for ten, 20, and 40 minutes as units, respectively, and signals $\overline{h}_1$, $\overline{h}_2$, $\overline{h}_4$, $\overline{h}_8$ having units of one, two, four and eight hours, respectively, are generated. The time as expressed in a combination of these signals and the signals are passed through switching circuit 5 without any further processing. The time signals are then applied to the inputs of decoder driver circuit 6 which then applies power to the segments of the figure 8 seven segment display thereby activating optical time display 7. FIG. 2 shows the time displayed on time display 7 in terms of hours, minutes and seconds.

The alarm set switch 26 is connected to the inputs of end gates 21 and 22 via inverter 20. Alarm set switch 26 is also connected directly to the inputs of logic gates 23 and 24. Alarm set switch 26 is also coupled to alarm mark optical display 13 through switch circuit 5, logic gate 16 and driver 12. The alarm set switch is also coupled to logic gate 17 via hour gate 16. Since the alarm set switch 26 is normally set at a logical zero, logic gates 21 and 22 are normally open. Consequently, if the adjustable switch 25 which is connected to clock pulse counter 4 and is normally at logical zero becomes a logical 1, operation of the hour adjustment switch 27 which is connected to the input of logic gate 22 by which the logical state is changed from 1 to 0 to 1 and back to 0, will change the time display of optical display 7 because the output of logic gate 22 is connected to clock pulse counter 4, and thus the signal contained in time display optical indicator 7 will be changed. Similarly, the minute display of optical time display 7 is adjusted by operating the minute adjustment switch 28. The adjustable switch 25 should be kept at a logical 0 state unless an adjustment is being performed to preclude any possibility of incorrect operation.

Figure 3:
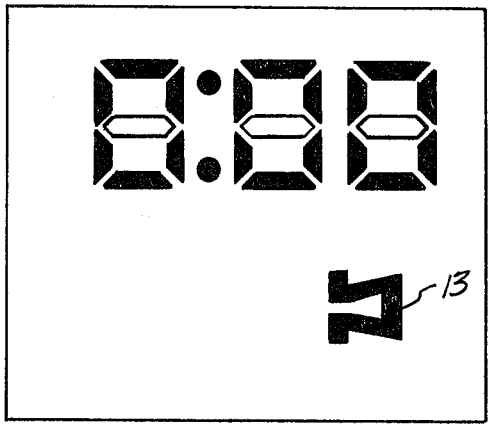
FIG. 3 is a graphical representation of the optical display indicating the content of the alarm time memory and the alarm mark.

If the alarm set switch 26 is switched to a logical 1, logic gates 23 and 24 will open, which in turn will operate on indicator switch 5 in such a way that the content of alarm memory 9 instead of the content of clock pulse counter 4 will be passed through indicator switch 5 and be displayed on time display 7. When alarm set switch 26 is placed at a logical 1 state, the alarm mark indicator 13 is activated and logic gate 17 is open. A representation of the display for this case is shown in FIG. 3. Since the hour adjustment switch 27 and the minute adjustment switch 28 are connected to the input side of logic gates 24 and 23, respectively, and since logic gates 24 and 23 are both connected to alarm memory 9, the time set for the alarm can be written into the alarm memory by operation of the hour adjustment switch 27 and the minute adjustment switch 28.

Figure 4:
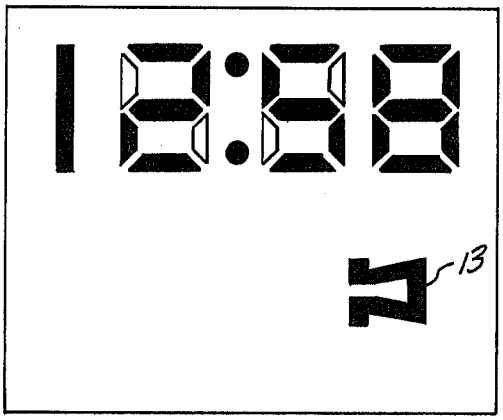
FIG. 4 is a graphical representation of the optical display showing the content of the alarm time memory while it is being changed and the alarm mark.
Figure 5:
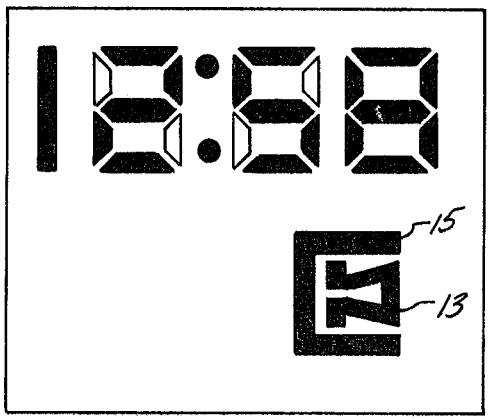
FIG. 5 is a graphical representation of the contents of the alarm time memory, the alarm mark, and the reproduce mark.
Figure 6:
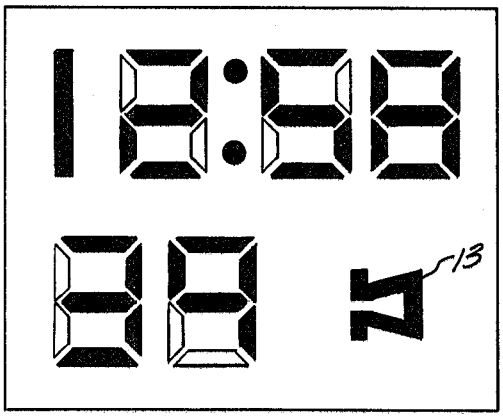
FIG. 6 is a graphical representation of the time being displayed and the alarm mark.
Figure 7:
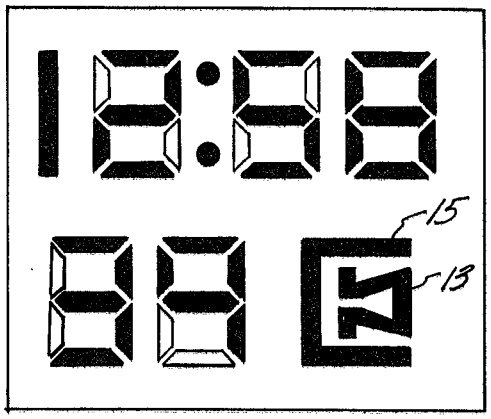
FIG. 7 is a graphical representation of the time displayed and the alarm mark and reproduce mark.

This memory content, passing through indicator switch 5 and decoder driver 6, will appear on time display 7. A graphical representation for this case is shown in FIG. 4. If a time is set in alarm memory 9, memory check circuit 11 detects the fact that a time is set in the alarm memory and activates alarm mark display 13 via logic gate 16 even when the logical state of alarm set switch 26 is a logical 0. Regardless of the logical state of alarm set switch 26, as long as a time is set in the alarm memory 9, the coincidence check circuit 10 sends out a logical 1 when the content of clock pulse counter 4 coincides with the content of alarm memory 9. The logical 1 output signal from coincidence check circuit 10 becomes an input to monostable multivibrator 31 and also an input to logic gate 19. Logic gate 19 always has a 1024 Hz alarm signal as one of its inputs; the alarm signal AS is generated by frequency dividing circuit 3. Since the alarm stop switch is normally set at a logical 1 state, the output of the coincidence check circuit 10 will open logic gate 19 and thus let the 1024 Hz alarm signal AS pass through the gate to sound the audible alarm device 32. Sounding of the audible alarm 32 occurs for one minute since the minimum unit of alarm memory 9 is one unit and consequently the output signal of coincidence check circuit 10 has a width of one minute. The alarm can be turned off sooner than one minute, if desired, by setting alarm stop switch 30 to a logical 0 state, thereby closing logic gate 19. Since repeat alarm switch 29 is normally set at a logical 0 state, logic gate 18 is normally open and alarm memory 9 is reset by the output signal of monostable multivibrator 31. Thus, the alarm state is cleared after the first sounding of the audible alarm so long as the repeat alarm switch 29 is set at the logical 0 state. If it is desired to repeat the sounding of the audible alarm on every output signal that comes out of coincidence check circuit 10, repeat alarm switch 29 must be set at a logical 1 state which closes gate 18 thereby preventing the output of monostable multivibrator 31 from passing through gate 18 and resetting alarm memory 9. When repeat switch 29 is in the logical 1 state, logic gate 17 is open thereby turning on reproduce mark display 13. FIG. 5 is a graphical representation of the optical display of the electronic timepiece with the alarm set switch 26 set at the logical 1 state, the alarm memory set at 12 hours and 58 minutes, and the repeat alarm switch 29 at the logical 1 state. FIG. 6 is a graphical representation of the optical display in the normal condition with alarm set switch 26 set at the logical 0 state and the alarm time set in alarm memory 9. The display of FIG. 6 becomes the display shown in FIG. 7 when the repeat alarm switch 29 is set at the logical 1 state.

FIG. 8 is a logic circuit diagram of a quartz crystal oscillator 2 in which inverts G40 and G401, crystal 1, resistors R1 and R2, a capacitor C1 and a variable capacitor C2 are coupled together so that by means of inverter G40, bias resistor R1, stabilizing resistor R2 and input/output capacitor C1 and C2, which at least one must be adjustable, crystal 1 maintains a prescribed frequency such as 32,768 Hz to an extremely high degree of accuracy. The output of the crystal oscillator is sufficiently amplified by inverter G401 and the output of the quartz crystal oscillator 2 appears at output terminal $\phi$32768.

FIG. 9 is a logic circuit diagram of a frequency divider circuit 3. The input of frequency divider circuit 3 is coupled to output terminal $\phi$32768 and $\phi$1 of 1 Hz is the output of divider circuit 3. Frequency divider circuit 3 is constructed by connecting 15 flip flops F1 through F15, three inverters G402, G4010 and G3900 and two level up circuits LU1 and LU2 together.

In operation, the signal at terminal $\phi$32768 is introduced to the $\phi$ input of flip flop F1 while its inversion is connected to the $\overline{\phi}$ and Q and $\overline{Q}$ are outputs of flip flop F1 in response to inputs $\phi$ and $\overline{\phi}$, respectively. Accordingly, output signals Q and $\overline{Q}$ are generated at a rate of one pulse for every two input pulses of $\phi$ and $\overline{\phi}$. Consequently, the frequency is reduced one-half for each flip flop. This process is repeated nine times until flip flop F9 is reached. During the frequency dividing process, a signal $\phi$1024 of 1024 Hz is taken out from the Q output of flip flop F5 and used as the alarm signal AS. In other words, the alarm sound is 1024 Hz. The output signal from flip flop F9 is then passed through a level-out circuit LU1 so that a potential difference of 1.5 volts that exists between $V_{ss}$ and $V_{dd}$ is now made 3 volts from this point on. At the output of level-out circuit LU1, which is at a frequency of 64 Hz, the clock pulse $\phi_{cl}$ of 64 Hz is branched out via two inverters G40 and G3900. Also, 32 Hz signals $\phi$32 and $\overline{\phi 32}$ are taken out at outputs Q and $\overline{Q}$ of flip flop F10. The frequency is divided from 32,768 Hz down to 1 Hz in 15 steps in flip flops F1 through F15.

Figures 12, 13, 14:
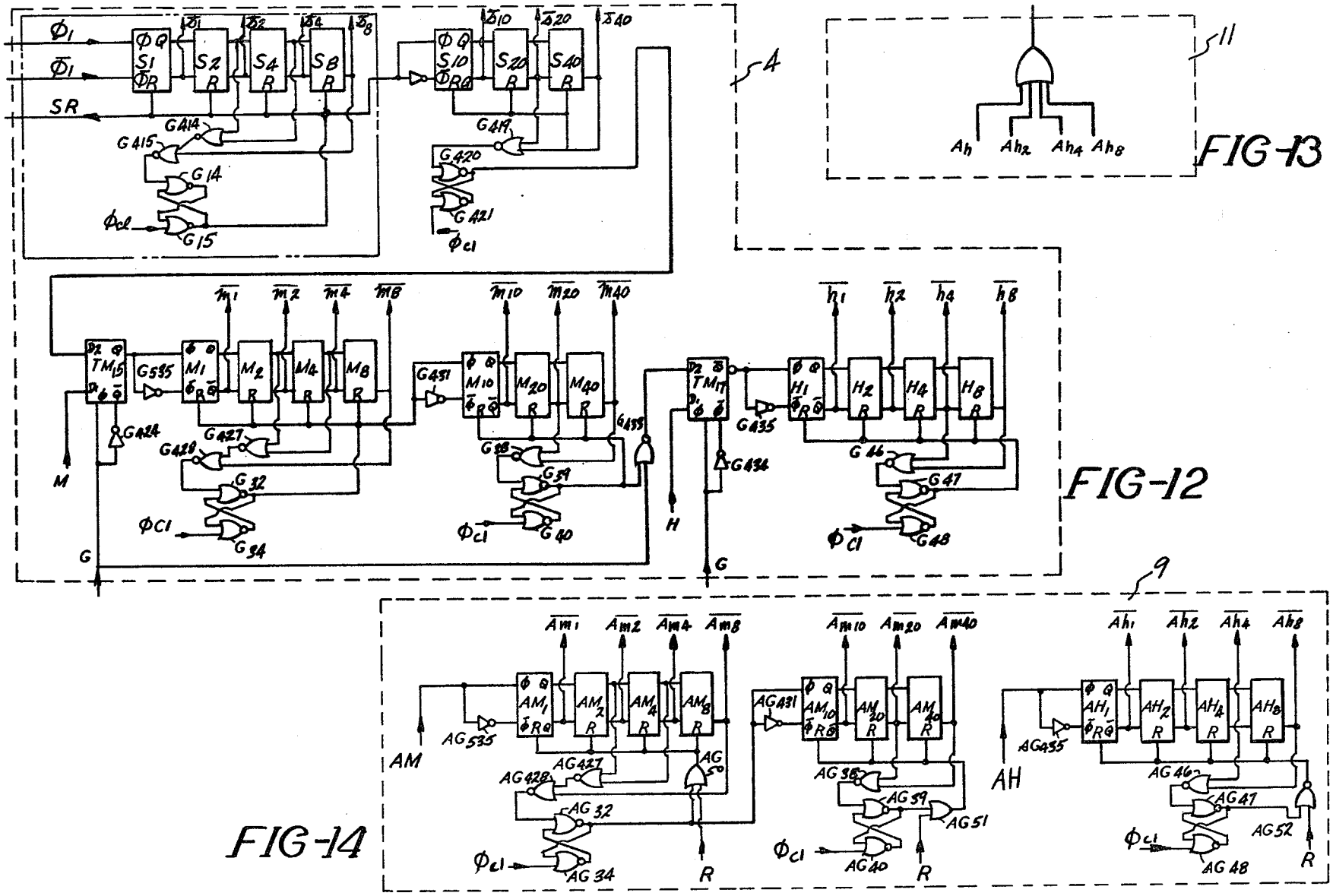
FIG. 12 is a logic circuit diagram of a clock pulse counter utilized in the electronic timepiece of FIG. 1.
FIG. 13 is a logic circuit diagram of a memory check circuit utilized in the electronic timepiece of FIG. 1.
FIG. 14 is a logic circuit diagram of the alarm memory utilized in the electronic timepiece of FIG. 1.

FIG. 12 is a logic circuit diagram clock pulse counter circuit 4. Clock pulse counter circuit 4 has signal $\phi$1 of 1 Hz as its input. Its output signals are $\overline{s}_1$, $\overline{s}_2$, $\overline{s}_4$, $\overline{s}_8$, $\overline{s}_{10}$, $\overline{s}_{20}$, $\overline{s}_{40}$, $\overline{m}_1$, $\overline{m}_2$, $\overline{m}_4$, $\overline{m}_8$, $\overline{m}_{10}$, $\overline{m}_{20}$, $\overline{m}_{40}$, $\overline{h}_1$, $\overline{h}_2$, $\overline{h}_4$, and $\overline{h}_8$, having periods of one second, two seconds, four seconds, eight seconds, ten seconds, 20 seconds, 40 seconds, one minute, two minutes, four minutes, eight minutes, ten minutes, 20 minutes, 40 minutes, one hour, two hours, four hours, and eight hours, respectively. Clock pulse counting circuit 4 comprises 18 flip flops, S1 through S8, S10 through S40, M1 through M8, M10 through M40 and H1 through H8, two transmission gates TM15 and TM17, lower gates G414, G415, G14, G15, G419, G420, G421, G427, G428, G32, G34, G38, G39, G40, G431, G46, G47, G48, lower gates G16 and G43, inverters G534, G424, G535, G431, G434, G435. Signals $\phi$1 and $\overline{\phi}$1 are coupled to the $\phi$ and $\overline{\phi}$ inputs of flip flop S1. Flip flops S1 through S8, S10 through S40, M1 through M8, M10 through M40 and H1 through H8 are connected together to form binary counter circuits.

Since the clock pulse counter circuit 4 consists of a number of circuits of similar structure, the function of the clock pulse counter circuit 4 will be first explained based on the elements contained within the double dotted chain line boundary, viz. A counter of one digit seconds. Outputs $\phi$1 and $\overline{\phi}$1 of frequency divider circuit 9 are the inputs of inputs $\phi$ and $\overline{\phi}$ of flip flop S1, respectively. Since flip flop S1 operates on negative logic, the output $\overline{s}_1$ becomes a logical 1 at the first downward edge of signal $\phi$1. The first downward edge of $\phi$1 occurs one second after the proceeding downward edge of $\phi$1 (which is taken as the starting time point). Consequently, $\overline{s}_1$ becomes a logical 0, one second after the start. Since flip flop S2 operates on the downward edge of $\overline{s}_1$ flip flop S2 changes to a logical 1, two seconds after the start, and $\overline{s}_2$ becomes 0. Since flip flop S4 operates on the downward edge of $\overline{s}_2$, $\overline{s}_4$ changes to a logical 1 four seconds after the start, and $\overline{s}_4$ becomes a logical 0. Since flip flop S8 acts on the downward edge of $\overline{s}_4$, $\overline{s}_8$ changes to a logical 1 eight seconds after the start, and $\overline{s}_8$ becomes a logical 0. Signals $\overline{s}_1$, $\overline{s}_2$, $\overline{s}_4$, and $\overline{s}_8$, are generated in this manner from signals $\phi$1 and $\overline{\phi 1}$. Signals $\overline{s}_1$, $\overline{s}_2$, $\overline{s}_4$ and $\overline{s}_8$ are all in the logical 0 state at the ninth second interval from the start. When signal $\overline{s}_2$ changes from a logical 0 to a logical 1 at the tenth second, the output of NOR gate G414 becomes 0 since its input changes from 0,0 to 0,1, while the output of NOR gate G415 becomes a logical 1. Since signals $\overline{s}_2$, $\overline{s}_4$, and $\overline{s}_8$ are respectively in a logical 1 state, a logical 0 state, and logical 0 state for the first time at the tenth second interval, this combination is used as a reset signal which is coupled to the reset terminals of flip flop S1, S2, S4 and S8 and reset terminals F10, F11, F12, F13, F14, and F15 of frequency divider circuit 3 via a set, reset flip flop (RSFF) that is constructed from NOR gates G14 and G15. In said RSFF, the output of NOR gate G15, normally being kept at a 0 by $\phi_{cl}$, changes to a logical 1 by a logical 1 output from said NOR gate G415, and thus resets flip flops S1 through S8 thereby making $\overline{s}_1$ through $\overline{s}_8$ a logical 0 and thus the output of NOR gate G415 becomes a logical 0 and finally the reset action ends when the output of NOR gate G15 becomes a logical 0 due to the subsequent incoming $\phi_{cl}$ from frequency divider circuit 3.

Since the reset signal SR from RSFF is at a logical 1 state, the reset signal SR is applied to the $\phi$ input of flip flop S10 and into $\overline{\phi}$ input via inverter G534 as the shift place signal. Flip flops S10, S20 and S40 operate substantially the same as flip flops S1, S2, S4 and S8 and produce signals $\overline{s}_{10}$, $\overline{s}_{20}$, and $\overline{s}_{40}$. For this case the only difference is that the reset occurs at the 60th minute point from the start. Accordingly, reset occurs when $\overline{s}_{20}$ and $\overline{s}_{40}$ become a logical 0 simultaneously.

Transmission gate TM15 transmits the input signal applied at D2 directly to its Q output without any change when the input signal is at its $\phi$ and $\overline{\phi}$ inputs is respectively a logical 0 and a logical 1. Transmission gate 15 transmits the input signal applied at D1 which comes from the emitted adjustment switch 28 to its Q output without any change when the input signal is at $\phi$ and $\overline{\phi}$ is respectively a logical 1 and a logical 0. The input signals to inputs $\phi$ and $\overline{\phi}$ of transmission gate TM15 are the signal G which is the output of adjustable switch 25.

The reset signal which resets flip flops S10, S20 and S40 is also the signal that is applied directly to the $\phi$ input of flip flop M1 and to the $\overline{\phi}$ input of flip flop F1 via inverter G535. The outputs of the counter formed by flip flops M1 through M8 are the signals $\overline{m}_1$ through $\overline{m}_8$. The counter formed by flip flops M1 through M8 operates in substantially the same way as the seconds counter formed by the flip flops S1 through S8. Furthermore, the NOR gate G427, G428 and G32 and G34 operate in substantially the same manner as NOR gates G414, G415, G14 and G15. Also, in substantially the same way, when signals $\overline{m}_2$, $\overline{m}_4$ and $\overline{m}_8$ are respectively in the logical 1 state, logical 0 state, and logical 0 state, the flip flops M1 through M8 are reset and the reset signal is applied to the $\phi$ input and to the $\overline{\phi}$ input through inverter G431 of flip flop M10.

Flip flops M10 through M40 operate in substantially the same way as flip flops S10 through S40. The reset signal for flip flops M10, M20, M40 is applied to the D2 input of transmission gate TM17 after being inverted by NOR gate G433. Transmission gate TM17 transmits the input signal applied at D2 directly to its output $\overline{Q}$ without any change when the signal applied to the $\phi$ and $\overline{\phi}$ inputs is respectively a logical 1 and a logical 0. Since the output at $\overline{Q}$ of transmission gate TM17 is a logical 1 when the reset signal from the minutes counter flip flops M10 through M40 is at a logical 1 state, the output signal from $\overline{Q}$ is applied to the $\phi$ input of flip flop H1 without any change and to the $\overline{\phi}$ input of flip flop H1 after and inversion via inverter G435. Flip flops H1 through H8 constitute a counter of order 12 having the reset signal from the minute counter formed by flip flops M10 through M40 as an input. Flip flops H1 through H8 generate output signals $\overline{h}_1$ through $\overline{h}_8$. The hours counter formed by flip flops H1 through H8 operate in substantially the same manner as the seconds counter formed by the flip flops S1 through S8 except that the reset signal is generated when both $\overline{h}_4$ and $\overline{h}_8$ signals become a logical 0.

FIG. 14 is a logic circuit diagram of the alarm memory 9. The input AM is the output of logic gate 23 of switch circuit 8 and the input AH is the output of logic gate 24 of switch circuit 8. Alarm memory 9 is substantially similar to the minute counter and hour counter of clock pulse counter circuit 4 and therefore the following explanation is limited only to its main features. The output signals of alarm memory 9 are $\overline{A}_{m1}$ through $\overline{A}_{m8}$, $\overline{A}_{m10}$ through $\overline{A}_{m40}$ and $\overline{A}_{h1}$ through $\overline{A}_{h8}$.

As previously stated, the counter is formed by flip flops $AM_1$ through $AM_8$ and $AM_{10}$ through $AM_{40}$ which operates substantially the same as the minutes counters formed by flip flops $M_1$ through $M_8$ and $M_{10}$ through $M_{40}$ except that the input to the counter is the signal AM instead of the reset signal from the seconds counter. Furthermore, the counter formed by flip flops $AH_1$ through $AH_8$ is substantially the same as the hours counter formed by flip flops $H_1$ through $H_8$ except that the input signal is the signal H instead of the reset signal from the minutes counters. Furthermore, there is an additional difference in the operation of the counters which form the alarm memory 9. This additional difference is that the reset signal for the counters is controlled by signal R which is an output of gate 18 in FIG. 1. Reset signal R is applied to OR gates AG50, AG51 and AG42 which together with the normal reset signal forms the actual reset signal for the counters.

FIG. 11 is a logic circuit diagram of switch circuit 5. Switch circuit 5 comprises transmission gates TM1 through TM11. ALM signal from alarm set switch 26 is applied directly to the $\overline{\phi}$ inputs of all of the transmission gates TM1 through TM11 and applied to the $\phi$ input of all of the transmission gates TM1 through TM11 after being inverted by inverter G125. Signal $\overline{m}_1$ is applied to the $D_1$ input of transmission gate TM1 and signal $\overline{A}_{m1}$ is applied to the $D_2$ input of transmission gate TM1. In a similar fashion, the hours and minutes outputs from clock pulse counter 4 and alarm memory 9 are applied in pairs to the remainder of the transmission gates. Accordingly, when alarm set switch 26 is set at the logical 0 state, $\phi$ and $\overline{\phi}$ become 1 and 0 and inputs $\overline{m}_1$ though $\overline{m}_{40}$ and $\overline{h}_1$ through $\overline{h}_8$ appear at the $\overline{Q}$ outputs of the respective transmission gate in an inverted form. When switch 26 is at the logical 1 state and a logical 0 and logical 1 appear at the $\phi$ and $\overline{\phi}$ inputs of transmission gates TM1 through 1, the inputs $\overline{A}_{m1}$ through $\overline{A}_{m40}$ and $\overline{A}_{h1}$ through $\overline{A}_{h8}$ will appear at the $\overline{Q}$ outputs in an inverted form. Furthermore, the outputs of transmission gates TM1 through TM11 is split into two signal paths and one of the signal paths is passed through an inverter thereby making the inverted output of each transmission gate available. Looking at the overall operation of the display switch 5 circuit, when the alarm set switch 26 is in the normal state, the content of clock pulse counter 4 is applied to decoder driver 6; and alternately when alarm set switch 26 is not in the normal state, the contents of alarm memory 9 is applied to decoder driver 6.

FIG. 10 is a logic circuit diagram of the coincidence detector circuit 10. Coincidence detector circuit 10 comprises exclusive OR gates 192 through 202. Each exclusive OR gate has two inputs and a single output. Signals $\overline{m}_1$ and $\overline{A}_{m1}$ are applied to exclusive OR gate G192. Similarly, the remainder of the minutes and hours signals from alarm memory 9 and clock pulse counter 4 are applied to the inputs of exclusive OR gates G194 through G202. The outputs of exclusive OR gates G192 through G195 are applied to the inputs of NOR gate G204. The outputs of exclusive OR gates G196 through G198 are applied to the inputs of OR gate G205. The outputs of exclusive OR gates G199 through G202 are applied to the inputs of NOR gate G206. The outputs of NOR gates G204 through G206 are applied to the inputs of AND gate G207.

In operation, since an exclusive OR gate produces a logical 0 state as its output when its input signals are of the same state, the output of exclusive OR gate G192 is a logical 0 when signals $\overline{m}_1$ and $\overline{A}_{m1}$ coincide. Similarly, the outputs of the other exclusive OR gates G193 through G202 are also a logical 0 when their input signals coincide. Accordingly, when the outputs of all of the exclusive OR gates G1922 through G202 is a 0 the outputs of NOR gates G204 through G206 is a logical 1. Therefore, when the outputs of NOR gates G204 through G206 are a logical 1 the output of AND gate G207 is a logical 1. In other words, when all of the signal pairs applied to exclusive OR gates G192 through G202 coincide the output of coincidence detector circuit 10 is a logical 1.

FIG. 13 is a logic circuit diagram of memory check circuit 11. Memory check circuit 11 comprises an OR gate. The inputs of the OR gate comprise the hours signals $\overline{A}_{h1}$ through $\overline{A}_{h8}$ from alarm memory circuit 9. If an alarm time is set in alarm memory 9, one of the signals $\overline{A}_{h1}$ through $\overline{A}_{h8}$ is a logical 1. If one of the signals $\overline{A}_{h1}$ through $\overline{A}_{h8}$ is a logical 1, an alarm time setting is written in alarm memory 9. Furthermore, if one of the input signals to the OR gate is a logical 1, the output of the OR gate and consequently the output of the memory check circuit 11 is a logical 1.

Figure 15:
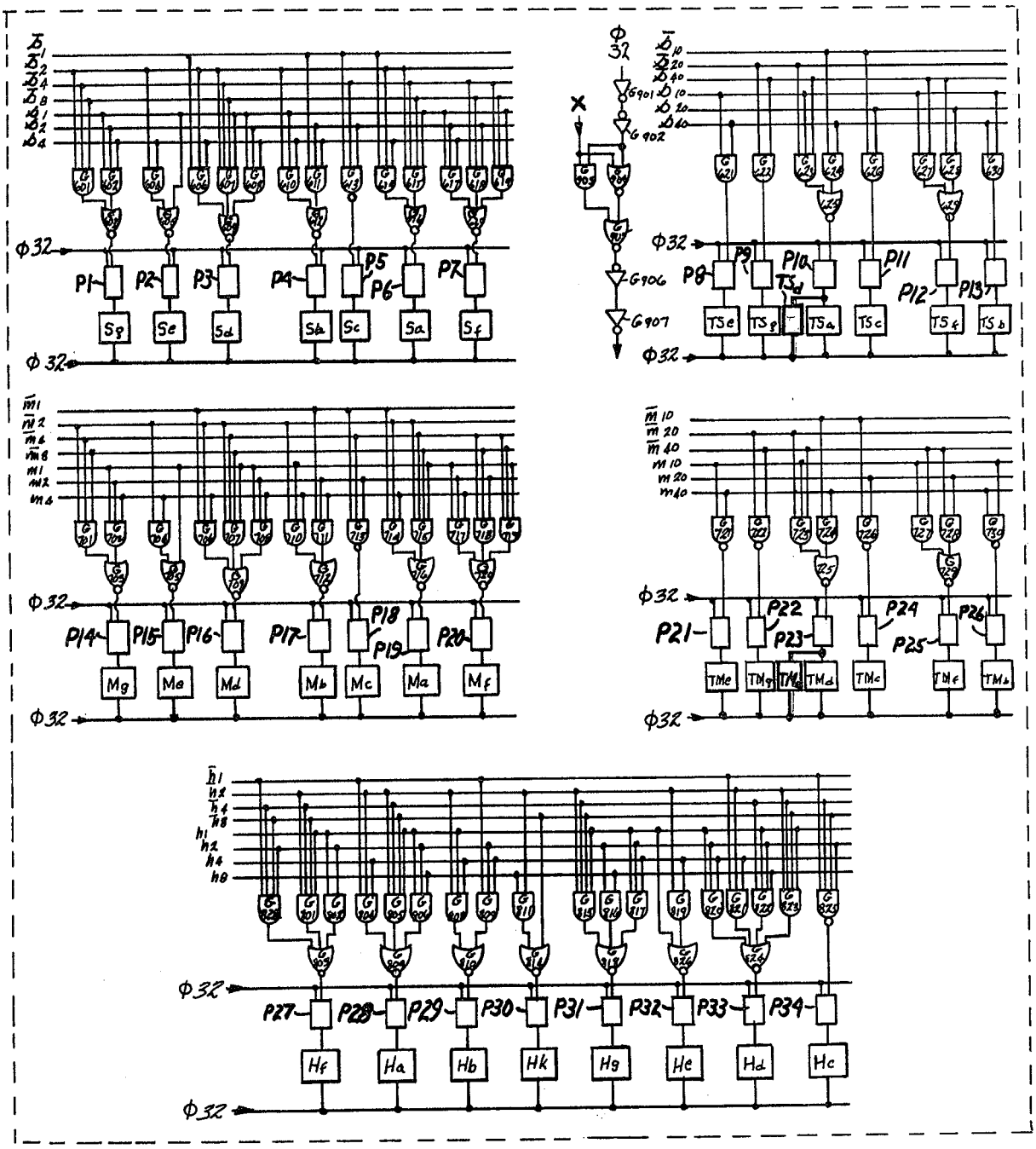
FIG. 15 is a logic circuit diagram of a decoder driver utilized in the electronic timepiece of FIG. 1.

FIG. 15 is a logic circuit diagram of the decoder driver 6. Since the inputs to decoder driver 6 are the output signals from indicator switch circuit 5, the input signals to decoder driver circuit 6 may be either $\overline{s}_1$ through $\overline{h}_8$, the time signals in seconds, minutes and hours from clock pulse counter circuit 4, or signals $\overline{A}_{m1}$ through $\overline{A}_{h8}$, the contents of alarm memory 9 in minutes and hours. Since the input of decoder driver circuit 6 may be the output of clock pulse counter 4 or the output of alarm memory circuit 9 depending on the state of alarm set switch 26, the operation of decoder driver circuit 6 will be described in terms of the signals from clock pulse counter circuit 4 to simplify the description. The operation of decoder driver circuit 6 is substantially the same if the input signals are the contents of alarm memory circuit 9 except that the portion of decoder driver circuit 6 which pertains to the seconds portion of the display is not utilized. Furthermore, for the sake of the following description the display device is assumed to be a liquid crystal device common in the prior art.

The driver for the 100ths position of the seconds display comprises signal lines $\overline{s}_1$ through $\overline{s}_8$ and $s_1$ through $s_4$ from indicator switch circuit 5. Signal lines $\overline{s}_2$, $\overline{s}_4$ and $\overline{s}_8$ are coupled to the input of AND gate G601. Signal lines $s_1$, $s_2$ and $s_4$ are connected to the input of AND gate G602. The outputs of AND gates G601 and G602 are coupled to the inputs of NOR gate G603. The output of NOR gate G603 and the signal $\phi$32 from frequency divider circuit 3 are applied to phase matching circuit P1. The output of phase matching circuit P1 is applied to one electrode of display segment $S_g$. The other electrode of display segment $S_g$ is coupled directly to the signal $\phi$32. Signal lines $\overline{s}_2$ and $s_4$ are coupled to the inputs of AND gate G604. The output of AND gate G604 and signal line $s_1$ are coupled to the inputs of NOR gate G605. In a similar manner as previously described, display segment $S_e$ is coupled respectively to signal $\phi$32 and the output of NOR gate G605 via phase matching circuit P2 and directly to signal $\phi$32.

Signal lines $\overline{s}_1$, $\overline{s}_2$ and $s_4$ are coupled to the inputs of AND gate G606. Similarly, signal lines $\overline{s}_2$, $\overline{s}_4$, $\overline{s}_8$ and $s_1$ are connected to the inputs of AND gate G607. Signal lines $s_1$, $s_2$ and $s_4$ are connected to the inputs of AND gate G608. The outputs of AND gates G606, G607, and G608 are connected to the input of NOR gate G609. Similar to the description above, the electrodes of display segment $S_d$ are coupled respectively to the output of NOR gate G609 and signal line $\phi$32 via phase matching circuit P3 and to signal $\phi$32. Signal line $\overline{s}_2$, $s_1$ and $s_4$ are coupled to the input of AND gate G610. Signal lines $\overline{s}_1$, $s_2$ and $s_4$ are coupled to the inputs of AND gate G611. The output of AND gates G610 and G611 are coupled to the inputs of NOR gate G612. In a similar fashion as previously described, the electrodes of display segment $S_b$ are coupled respectively to the output of AND gate G612 and signal $\phi$32 via phase matching circuit P4 and to signal $\phi$32. Signal lines $\overline{s}_1$, $\overline{s}_4$ and $s_2$ are connected to the inputs of NAND gate G613. Similar to that previously described, the electrodes of display element $S_c$ are connected respectively to signal $\phi$32 and the output of NAND gate G613 via phase matching circuit P5 and to signal $\phi$32.

Likewise, signals $\overline{s}_1$, $\overline{s}_2$, and $s_4$ are coupled to the inputs of AND gate G614. Signals $\overline{s}_2$, $\overline{s}_4$, $\overline{s}_8$, and $\overline{s}_1$ are coupled to the inputs of AND gate G615. The outputs of AND gates G614 and G615 are coupled to the inputs of NOR gate G616. Similar to that previously described the electrodes of display element $S_a$ are coupled respectively to signal $\phi$32 and the output of NOR gate G616 via phase matching circuit P6 and to signal $\phi$32. Signal $s_1$, $s_2$, and $s_4$ are coupled to the inputs of AND gate G617. Signals $\overline{s}_4$, $\overline{s}_8$, and $s_2$ are coupled to the inputs of AND gate G618. Signals $\overline{s}_4$, $\overline{s}_8$, and $s_1$ are coupled to the inputs of AND gate G619. The outputs of AND gates G617, G618, and G619 are coupled to the inputs of NOR gate G620 in a manner similar to that previously described, the two electrodes of display segment $S_f$ are coupled respectively to signal $\phi$32 and the output of NOR gate G620 via phase matching circuit P7 and to signal $\phi$32. That portion of decoder driver 6 which drives the 100ths place of the minutes display is coupled together substantially the same as that previously described for the 100ths place of the second display except that the signals utilized are $\overline{m}_1$ through $\overline{m}_8$ and $m_1$ through $m_4$ which are provided by indicator switch circuit 5.

That portion of decoder driver 6 which provides the 10ths place of the seconds display comprises signal lines $\overline{s}_{10}$ through $\overline{s}_{40}$ and $s_{10}$ through $s_{40}$. Signals $s_{10}$ and $s_{40}$ are coupled to the inputs of AND gate G621. The output of AND gate G21 and signal $\phi$32 are coupled to the input of phase matching circuit P8. The electrodes of segment $TS_e$ are coupled respectively to the output of phase matching circuit P8 and signal $\phi$32. Signal $\overline{s}_{20}$ and $\overline{s}_{40}$ are coupled to the inputs of AND gate G622. The output of AND gate G622 and signal $\phi$32 are coupled to the input of phase matching circuit P9. The electrodes of segment $TS_g$ of the display are coupled respectively to the output of phase matching circuit P9 and signal $\phi$32. Signals $\overline{s}_{20}$, $\overline{s}_{40}$ and $s_{10}$ are coupled to the input of AND gate G623 and signals $\overline{s}_{10}$ and $s_{40}$ are coupled to the input of AND gate G624. The outputs of AND gates G623 and G624 are coupled to the input of NOR gate G625 and the output of NOR gate G625 and signal $\phi$32 are coupled to the input of phase matching circuit P10. The electrodes of segment $TS_a$ and segment $TS_d$ are coupled respectively to the output of phase matching circuit P10 and signal $\phi$32. Signal $\overline{s}_{10}$ and $s_{20}$ are coupled to the input of AND gate G626. The output of AND gate G626 and signal $\phi$32 are coupled to the input of phase matching circuit P11. The electrodes of segment $TS_c$ of the display are coupled respectively to the output of phase matching circuit P11 and signal $\phi 32$. Signal $\bar{s}_{40}$ and $s_{10}$ are coupled to the input of AND gate G627 and signal $\bar{s}_{40}$ and $s_{20}$ are coupled to the inputs of AND gate G628. The outputs of AND gates G627 and G628 are coupled to the inputs of NOR gate G629 and the output of NOR gate G629 and signal $\phi 32$ are coupled to the input of phase matching circuit P12. The electrodes of segment $TS_f$ of the display are coupled respectively to the output of phase matching circuit P12 and signal $\phi 32$. Signals $s_{10}$ and $s_{40}$ are coupled to the input of AND gate G630 and the output of AND gate G630 and signal $\phi 32$ are coupled to the input of phase matching circuit P13. The electrodes of segment $TS_b$ of the display are coupled respectively to the output of phase matching circuit P13 and to signal $\phi 32$. That portion of decoder driver 6 which provides the 10ths place of the minutes display is substantially the same as that which applies the 10ths place of the seconds display except that minute signals $\bar{m}_{10}$ through $\bar{m}_{40}$ and $m_{10}$ through $m_{40}$ from indicator switch circuit 5 are utilized as the inputs.

That portion of decoder driver 6 which provides the hours display comprises signals $\bar{h}_1$ through $\bar{h}_8$ and $h_1$ through $h_8$. Signals $\bar{h}_1$, $\bar{h}_4$, $\bar{h}_8$ and $h_2$ are coupled to the input of AND gate G828 and signals $\bar{h}_2$, $\bar{h}_4$, $\bar{h}_8$ and $h_1$ are coupled to the inputs of AND gate G801. Signals $h_1$ and $h_2$ are coupled to the inputs of AND gate G802 and the outputs of AND gates G828, G801, and G802 are coupled to the inputs of NOR gate G803. The output of NOR gate G803 and signal $\phi 32$ are coupled to the input of phase matching circuit P27 and the electrodes of segment $H_f$ are coupled respectively to the outputs of phase matching circuit 27 and signal $\phi 32$. Signals $\bar{h}_1$, $\bar{h}_2$ and $h_4$ are coupled to the inputs of AND gate G804 and signals $\bar{h}_2$, $\bar{h}_4$, $\bar{h}_8$ and $h_1$ are coupled to the inputs of AND gate G805. Signals $h_1$, $h_2$ and $h_8$ are coupled to the input of AND gate G806 and the outputs of AND gates G804, G805 and G806 are coupled to the input of NOR gate G809.

Signals $\bar{h}_2$, $h_1$ and $h_4$ are coupled to the inputs of AND gate G808 and signals $\bar{h}_1$, $h_2$ and $h_4$ are coupled to the inputs of AND gate G809. The outputs of AND gates G808 and G809 are coupled to the inputs of NOR gate G810. Signals $\bar{h}_2$ and $h_8$ are coupled to the inputs of AND gate G811 and the output of AND gate G811 and signal $\bar{h}_8$ are coupled to the inputs of NOR gate G814.

Signals $\bar{h}_2$, $\bar{h}_4$, $\bar{h}_8$ and $h_1$ are coupled to the inputs of AND gate G815 and signals $h_2$ and $h_8$ are coupled to the inputs of AND gate G816. Signals $h_1$, $h_2$ and $h_4$ are coupled to the inputs of AND gate G817 and the outputs of AND gates G815, G816 and G817 are coupled to the inputs of NOR gate G818. Signals $\bar{h}_2$ and $h_4$ are coupled to the inputs of AND gate G819 and the output of AND gate G819 together with signal $h_1$ are coupled to the inputs of NOR gate G826.

Signals $h_1$, $h_2$ and $h_4$ are coupled to the inputs of AND gate G820 and signals $\bar{h}_1$, $\bar{h}_2$ and $h_4$ coupled to the inputs of AND gate G821. Signals $\bar{h}_4$, $h_1$, $h_2$ and $h_8$ and signals $\bar{h}_2$, $\bar{h}_4$, $\bar{h}_8$ and $h_1$ are coupled respectively to AND gates G822 and G823. The outputs of AND gates G820, G821, G822 and G823 are coupled to the inputs of NOR gate G824.

Signals $\bar{h}_1$, $\bar{h}_4$, $\bar{h}_8$ and $h_2$ are coupled to the inputs of NAND gate G825. In a manner substantially the same as previously described, the electrodes of segments $H_a$, $H_b$, $H_k$, $H_g$, $H_e$, $H_d$ and $H_c$ are coupled to the outputs of their associated gates via phase matching circuits P28 through P34 and to signal $\phi 32$.

The operation of the decoder driver 6 for the 10ths of a seconds place of base 6 will be explained first by referring to both FIG. 15 and to the Table shown in FIG. 16. Since segments $TS_a$ and $TS_d$ are not on for numerals 1 and 4, segments $TS_a$ and $TS_d$ are off when signals $\bar{s}_4$, $\bar{s}_2$ and $s_1$ are a logical 1 and when signals $s_4$ and $\bar{s}_1$ are both a logical 1.

Since segment $TS_b$ is off for numeral 5, it is turned off when both signals $s_4$ and $s_1$ are a logical 1. Furthermore, since segment $TS_c$ is off for numeral 2, segment $TS_c$ is off when both signals $s_2$ and $\bar{s}_1$ are both a logical 1. Also segment $TS_e$ is off for numerals 1, 3, 4 and 5. Therefore, $TS_e$ is off when signal $s_1$ is a logical 1 or $s_4$ is a logical 1. Segment $TS_f$ is off for the numerals 1, 2 and 3. Therefore, segment $TS_f$ is off when signals $\bar{s}_4$ and $s_1$ are both a logical 1 or when signals $\bar{s}_4$ and $s_2$ are both a logical 1. Segment $TS_g$ is off for numerals 1 and 2. Accordingly, segment $TS_g$ is off when signals $\bar{s}_4$ and $\bar{s}_2$ are both a logical 1.

The operation of the driver decoder 6 for the 100ths seconds place will be explained by referring to FIGS. 15 and 16. Segment $S_a$ is off for the numerals 1 and 4. Therefore, segment $S_a$ is off when signals $\bar{s}_8$, $\bar{s}_4$, $\bar{s}_2$ and $s_1$ are all a logical 1 or when signals $s_4$, $\bar{s}_2$ and $\bar{s}_1$ are all a logical 1. Likewise, segment $S_b$ is off for the numerals 5 and 6. Therefore, segment $S_b$ is off when signals $\bar{s}_4$, $\bar{s}_2$ and $s_1$ are all a logical 1 or when signals $s_4$, $s_2$ and $\bar{s}_1$ are all a logical 1.

Furthermore, $S_c$ is off for numeral 2. Therefore, segment $S_c$ is off when signals $\bar{s}_4$, $s_2$ and $\bar{s}_1$ are all a logical 1. $S_d$ is off for numerals 1, 4 and 7. Accordingly, segment $S_d$ is off when signals $\bar{s}_8$, $\bar{s}_4$, $\bar{s}_2$ and $\bar{s}_1$ are all a logical 1 or when signals $s_4$, $\bar{s}_2$ and $\bar{s}_1$ are all a logical 1 or when signals $s_4$, $s_2$ and $s_1$ are all a logical 1. Segment $S_e$ of the display is off for the numerals 1, 3, 4, 5, 7, and 9. Accordingly, segment $S_e$ is off when signal $s_1$ is a logical 1 or when signals $s_4$, $\bar{s}_2$ and $\bar{s}_1$ are all a logical 1. Furthermore, segments $S_f$ is off for the numerals 1, 2, 3 and 7. Accordingly, segment $S_f$ is off when either the signals $\bar{s}_8$, $\bar{s}_4$ and $s_1$ are all a logical 1 or when signals $\bar{s}_8$, $\bar{s}_4$ and $s_2$ are a logical 1 or when signals $s_4$, $s_2$ and $s_1$ are all a logical 1. Also, segment $S_g$ is off for the numerals 0, 1, and 7. Accordingly, segment $S_g$ is off when either signals $\bar{s}_8$, $\bar{s}_4$ and $\bar{s}_2$ or $s_4$, $s_2$, or $s_1$ are all a logical 1. The action of decoder driver 6 for the minutes places is substantially the same as that for the seconds place. Furthermore, the operation of the decoder driver 6 for the hours places is substantially the same as that of the 100ths position of the seconds display except that instead of operating on a base 10, the decoder 6 for the hours places operates on a base 12. Furthermore, the corelation of the operation of segments $H_a$, $H_b$, $H_c$, $H_d$, $H_e$, $H_f$, $H_g$ and $H_k$ and the signals lines $\bar{h}_1$ through $\bar{h}_8$ and $h_1$ through $h_8$ for each numeral of the display is clearly pointed out in FIG. 16.

The phase matching circuits P1 through 34 comprise an inverter G901 whose input is connected to the signal $\phi 32$ and whose output is coupled to the input of inverter G902. The output of inverter G902 is coupled to the inputs of both AND gate G905 and NOR gate G904. The signal X represents the signal derived by the individual logic combinations of decoder driver 6; i.e., the output of inverter G603. Signal X is coupled to inputs of both AND gate G903 and NOR gate G904 and the outputs of AND gate G903 and NOR gate G904 are coupled to the input of NOR gate G905. The output of NOR gate G905 is coupled to the input of inverter G906 whose output is coupled to the input of inverter G907.

The output of inverter G907 is coupled to the appropriate segment of the optical display such as segment $S_g$.

In operation, if the signal X to each segment is assumed to be a logical 0, the output of AND gate G903 is a logical 0 and the output of NOR gate G904 will be the signal $\bar{\phi}32$. Accordingly, the output of NOR gate G405 is the signal $\phi32$. Consequently, the signal $\phi32$ is the output of inverter G907 and if the signal $\phi32$ is applied at the opposing electrode of each segment, there will be no potential difference between the two electrodes and it is impossible to visually recognize the segment of the liquid crystal display. If the signal X is assumed to be a logical 1, the output of NOR gate G904 is a logical 0. Since the output of AND gate G903 is signal $\bar{\phi}32$, the signal $\phi32$ appears at the output of NOR gate G905. Consequently, the output of inverter G907 is the signal $\bar{\phi}32$ and if the signal $\phi32$ is applied at the opposing electrode of that segment, the potential difference between the electrodes is twice the voltage of signal $\phi32$ and it will then be possible to visually recognize the liquid crystal segment thereby enabling one to read the numerals. It should be apparent to one skilled in the art that if a display such as a light emitting diode display were utilized instead of the liquid crystal display, the phase matching circuits P1 through 34 would not be required.

In all cases, it is understood that the abovedescribed embodiment is merely illustrative of one of the many possible specific embodiments which represent the applications of the principles of the present invention. Furthermore, numerous and varied other arrangements can be readily devised in accordance with the principles of the present invention by those skilled in the art without departing from the spirit and scope of the invention.

We claim:

1. An electronic timepiece having an alarm, comprising an electro-optical display for selectively displaying the time and an alarm time setting on the same element of said display and for displaying a first alarm mark indicative of the condition of said alarm whereby the presence or absence of an alarm time setting is indicated by the presence or absence of said alarm mark; means for activating said first alarm mark for each coincidence of said alarm time setting and the time or for the first coincidence of said alarm time setting and the time; means for selecting the each coincidence or first coincidence mode of activation; means for displaying a second alarm mark in response to said selecting means whereby whether said alarm will be activated for each coincidence of said alarm time setting and the time or the first coincidence of said alarm time setting and the time is indicated by the presence or absence of said second alarm mark; and memory means for storing said alarm time setting and including resetting means, said means for selecting, including a logic means having an output connected to said resetting means, a first input connected to said means for activating said alarm, and a second input means connected to a selector switch means.

* * * * *